US011155276B2

(12) United States Patent
Conte

(10) Patent No.: US 11,155,276 B2
(45) Date of Patent: Oct. 26, 2021

(54) CABLE TRANSPORTATION SYSTEM FOR TRANSPORTING PEOPLE AND METHOD FOR OPERATING THE SAME

(71) Applicant: LEITNER S.P.A., Vipiteno (IT)

(72) Inventor: Giuseppe Conte, Bolzano (IT)

(73) Assignee: LEITNER S.P.A., Vipiteno (IT)

( * ) Notice: Subject to any disclaimer, the term of this patent is extended or adjusted under 35 U.S.C. 154(b) by 339 days.

(21) Appl. No.: 16/328,152

(22) PCT Filed: Sep. 1, 2017

(86) PCT No.: PCT/IB2017/055264

§ 371 (c)(1),
(2) Date: Feb. 25, 2019

(87) PCT Pub. No.: WO2018/042379

PCT Pub. Date: Mar. 8, 2018

(65) Prior Publication Data

US 2019/0193755 A1 Jun. 27, 2019

(30) Foreign Application Priority Data

Sep. 1, 2016 (IT) ..... 102016000088960

(51) Int. Cl.
*B61B 9/00* (2006.01)
*B61B 12/12* (2006.01)

(52) U.S. Cl.
CPC ..... *B61B 9/00* (2013.01); *B61B 12/12* (2013.01); *B61B 12/125* (2013.01)

(58) Field of Classification Search
CPC .... B61B 7/00; B61B 7/02; B61B 9/00; B61B 12/00; B61B 12/12; B61B 12/122; B61B 12/125; B61B 12/127
See application file for complete search history.

(56) References Cited

U.S. PATENT DOCUMENTS 3,871,303 A 3/1975 Woodling
2012/0103225 A1* 5/2012 Gubler ..... B61B 12/002 104/112

FOREIGN PATENT DOCUMENTS

EP 2 455 267 5/2012
EP 2455267 A1 * 5/2012 ..... B61B 9/00

OTHER PUBLICATIONS

Notification of the Recording of a Change for International Application No. PCT/IB2017/055264 dated Jan. 18, 2018.

(Continued)

*Primary Examiner* — Robert J McCarry, Jr.

(74) *Attorney, Agent, or Firm* — Neal, Gerber & Eisenberg LLP

(57) ABSTRACT

A cable transportation system extends along a track and has two haul cables driven respectively by respective motors and having respective mutually aligned end portions; a vehicle with two clamping devices configured to attach the vehicle to the haul cables; a passenger station at the end sections of the haul cables; two control cams arranged respectively at the end sections of the haul cables; and two actuators configured to bring the control cams into an operating position to open the clamping devices and into a resting position in which they do not interfere with the clamping devices, the control cams being spaced apart by a distance equal to the distance between the clamping devices in such a way that when the clamping device is at the control cam, the clamping device is at the control cam.

20 Claims, 7 Drawing Sheets

(56) References Cited

OTHER PUBLICATIONS

Notification Concerning Submission, Obtention or Transmittal of Priority Document for International Application No. PCT/IB2017/055264 dated Nov. 23, 2017.
International Search Report and Written Opinion for International Application No. PCT/IB2017/055264 dated Jan. 5, 2018.
PCT Demand for International Preliminary Examination and Reply to International Search Report and the associated Written Opinion for International Application No. PCT/IB2017/055264 dated Jun. 29, 2018.
Notification of Receipt of Demand by Competent International Preliminary Examining Authority (Form PCT/IPEA/402) for International Application No. PCT/IB2017/055264 dated Jul. 6, 2018.
Notification of Transmittal of the International Preliminary Report on Patentability (Form PCT/IPEA/416) for International Application No. International Application No. PCT/IB2017/055264 dated Aug. 13, 2018.

* cited by examiner

CABLE TRANSPORTATION SYSTEM FOR TRANSPORTING PEOPLE AND METHOD FOR OPERATING THE SAME

PRIORITY CLAIM

This application is a national stage application of PCT/IB2017/055264, filed on Sep. 1, 2017, which claims the benefit of and priority to Italian Patent Application No. 102016000088960, filed on Sep. 1, 2016, the entire contents of which are each incorporated by reference herein.

TECHNICAL FIELD

The present disclosure relates to a cable transportation system for transporting people.

In particular, the present disclosure relates to a cable transportation system which extends along a route whose overall length requires the use of at least two haul cables.

BACKGROUND

A cable transportation system of the type identified above is described in EP 2,455,267 A1 which describes transferring a vehicle from a first to a second haul cable and stopping the vehicle when the vehicle is simultaneously gripping the first and the second haul cable. The cable transportation system of the type described in EP 2,455,267 A1, on the one hand, makes it possible to stop the vehicle in the transfer phase but, on the other hand, imposes the condition of keeping the first haul cable and the second haul cable simultaneously stationary during the stop phase, to the detriment of the operation of the cable transportation system.

SUMMARY

A feature of the present disclosure is to provide a cable transportation system which is free of certain of the drawbacks of certain of the prior art.

In accordance with the present disclosure a cable transportation system for transporting people is provided, the system extending along a given or designated track and comprising:

- at least one first and one second haul cable, which are respectively actuated by a first and a second motor, extending at least partly along the track and have respective mutually aligned end sections;
- at least one vehicle comprising at least one first clamping device and one second clamping device, which are configured to selectively attach the vehicle to the first or the second haul cable; a passenger embarking and disembarking station at the end sections of the first and the second haul cable;
- a first and a second control cam, which are respectively arranged at the end sections of the first and the second haul cable; and
- a first and second actuator configured to selectively move the first and the second control cam between an operating position for opening and closing the first and the second clamping device and a resting position, in which the first and the second control cam do not non interfere with the first and the second clamping device, wherein the first and the second control cam are mutually spaced apart at a distance equal to the distance between the first and the second clamping device so that when the first clamping device is arranged at the second control cam, the second clamping device is arranged at the first control cam, and each control cam comprises an opening ramp and a closing ramp for the clamping devices so that, when each control cam is arranged in the operating position and the vehicle advances, the clamping device which interferes with the control cam performs a cycle of opening and closing.

It should be appreciated that based on the configuration described above, when the vehicle is arranged in the stop position the first and second clamping device can be relatively easily controlled via actuating the respective first and second control cam. It is also possible to keep the vehicle stationary at the passenger embarking and disembarking station, while one or both of the first or the second haul cables may be freely operated. In particular, the first haul cable is stopped at the end of a deceleration phase of the first haul cable so as to stop the vehicle and is kept stationary while the vehicle is clamped in the stop phase, while the second haul cable is freely operable until the second haul cable is stopped to be clamped by the vehicle and immediately accelerated as soon as the vehicle has been coupled.

In accordance with a particular embodiment of the present disclosure, the cable transportation system comprises a locking device to hold the vehicle stationary at the passenger embarking and disembarking station when the vehicle is released from the first haul cable and from the second haul cable.

It should be appreciated that based on the locking device it is possible to freely operate the first and second haul cable when the vehicle is stationary at the passenger embarking and disembarking station.

In particular, the locking device comprises a first locking member bound to the vehicle and a second locking member bound to the track, the first and the second locking member being couplable to each other. It is thus possible to lock the vehicle in a designated or given position.

In accordance with the present disclosure, the first locking member comprises a third clamping device (which in certain embodiments is aligned with the first and the second clamping devices) and the second locking member includes a cable section or a bar with a diameter equal to that of the cable section.

It may be advantageous in terms of economy of scale to make the first locking member in the form of a clamping device and the second locking member in the form of a cable section or a bar.

In particular, the locking device comprises a third control cam moveable between an operating position wherein the third control cam interferes with the first locking member for opening and closing the locking device and for keeping the locking device released from/attached to the second locking member and a resting position wherein the third control cam does not interfere with the first locking member. In other words, the control of the locking device is similar to the control of the clamping of the first and second clamping devices.

In accordance with the present disclosure, the cable transportation system comprises a control device, which comprises a control unit configured to acquire the position of the vehicle along the track and control the first and the second motor, and the first and the second actuator, and possibly the locking device depending on the position of the vehicle; and a plurality of sensors configured to retrieve the position of the vehicle along the track.

The control unit is further configured to control the first and the second motor, the first and the second actuator, and the locking device as a function of a predetermined cycle which comprises a vehicle deceleration phase, a vehicle stop phase, and a vehicle acceleration phase.

In practice, the vehicle makes a stop at the transfer from the first to the second cable according to a predefined cycle which however requires that the position of the vehicle is acquired via sensors.

In particular, the control unit is configured to arrange the first and the second control cam in the operating position or the resting position when the locking device locks the vehicle.

The first and second haul cables can thus be operated independently from one another in the vehicle's stop phase.

A further feature of the present disclosure is to provide a method for operating a cable transportation system for transporting people which is free of the drawbacks of the prior art.

In accordance with the present disclosure, a method is provided for operating a cable transportation system for transporting people, the method comprising the steps of:

advancing at least one vehicle comprising at least one first and one second clamping device along a designated or given track via a first or a second haul cable, which extend at least partly along the track and have respective mutually aligned end sections;

controlling the opening and closing of the first and second clamping devices at the end sections of the first and second haul cable via a first and second control cam moveable between an operating position wherein they interfere with the first and the second clamping devices for opening and closing in sequence the first and the second clamping devices and a resting position wherein they do not interfere with the first and the second clamping devices;

holding the vehicle stationary via a locking device or by clamping the vehicle to the first or the second haul cable; and releasing the vehicle from the first and the second haul cable or at least from either the first or the second haul cable, wherein each control cam comprises an opening ramp and a closing ramp for the clamping devices so that, when each control cam is arranged in the operating position and the vehicle advances, the clamping device, which interferes with the control cam, performs a cycle of opening and closing.

In practice, locking the vehicle via the locking device enables the first and second haul cables to be freely operated during the vehicle stop, while locking the vehicle via clamping to the first or the second haul cable enables the second or first haul cable to be freely operated during the stop phase.

Additional features are described in, and will be apparent from the following Detailed Description and the figures.

BRIEF DESCRIPTION OF THE DRAWINGS

Further characteristics and advantages of the present disclosure will become apparent from the following description of non-limiting examples of embodiment, with reference to the figures of the accompanying drawings, wherein.

DETAILED DESCRIPTION

Figure 1:
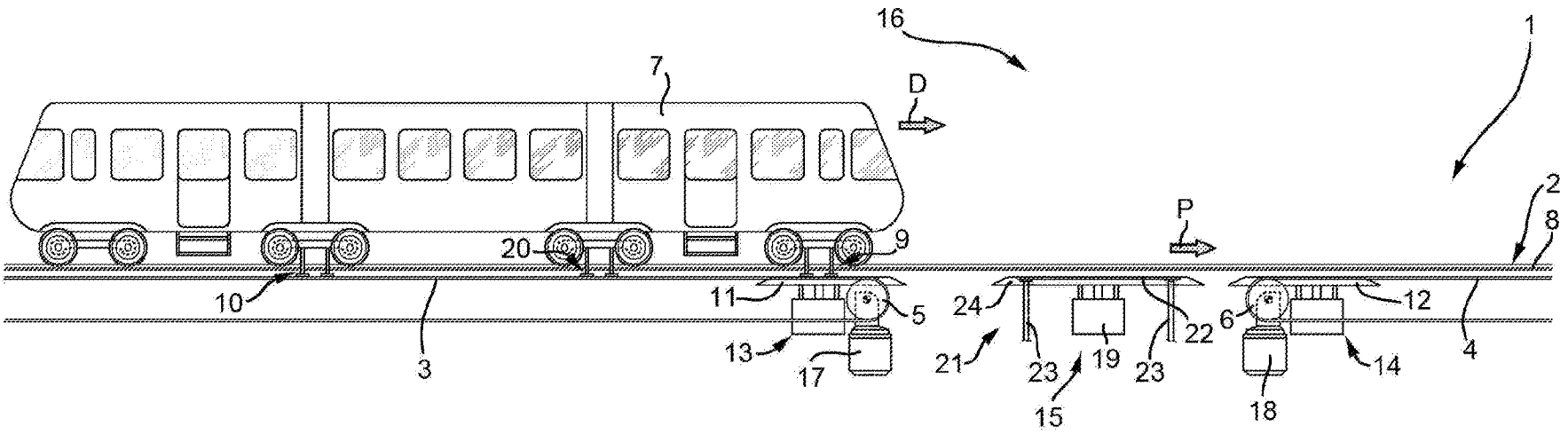
FIGS. 1 to 7 are schematic views in side elevation, with parts removed for clarity, of the cable transportation system of the present disclosure in a series of operating phases.

Referring now to the example embodiments of the present disclosure illustrated in FIGS. 1 to 14 and specifically with reference to FIGS. 1 to 7, the number 1 denotes in its entirety a cable transportation system, which extends along a track 2 and comprises two haul cables 3 and 4, which are wound around respective pulleys 5 and 6, extending at least partly along the track 2, and have respective mutually aligned end portions; and a vehicle 7 configured to be attached to the first haul cable 3 or the second haul cable 4. In the example shown, the track 2 defines a path P along which the vehicle 7 advances in a direction of travel D. The track 2 is defined by a pair of rails 8, only one of which is shown in the accompanying figures.

In the example shown, the vehicle 7 comprises two clamping devices 9 and 10, which are mutually aligned and configured to selectively attach the vehicle 7 to the haul cable 3 or the haul cable 4. The cable transportation system 1 comprises two cams 11 and 12, which are configured to cooperate with the clamping devices 9 and 10 so as to have the clamping devices 9 and 10 in an open position.

The cams 11 and 12 are selectively movable between an operating position in which the cams 11 and 12 intercept and open the clamping devices 9 and 10, and a resting position in which they do not interfere with the clamping devices 9 and 10 which are kept closed by respective springs (which are not shown). The cams 11 and 12 are linked to respective actuators 13 and 14 so as to arrange the cams 11 and 12 in respective operating and resting positions.

The cable transportation system 1 further comprises a locking device 15 configured to hold the vehicle 7 stationary when the vehicle 7 is simultaneously released by both haul cables 3 and 4 and to enable passengers to safely board and disembark from the vehicle 7. In other words, in the phase of transferring from the haul cable 3 to the haul cable 4, the vehicle 7 is held stationary at a passenger embarking and disembarking station 16 arranged at the end sections of the haul cables 3 and 4. The haul cables 3 and 4 are driven by respective motors 17 and 18 shown schematically in FIGS. 1 to 6.

Figure 3:
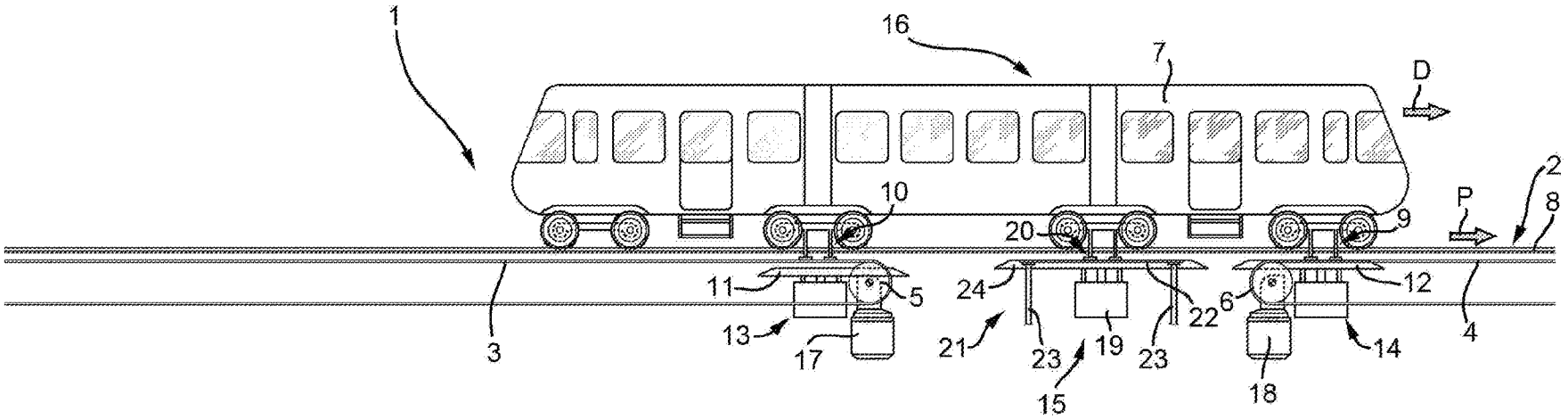
Figure 4:
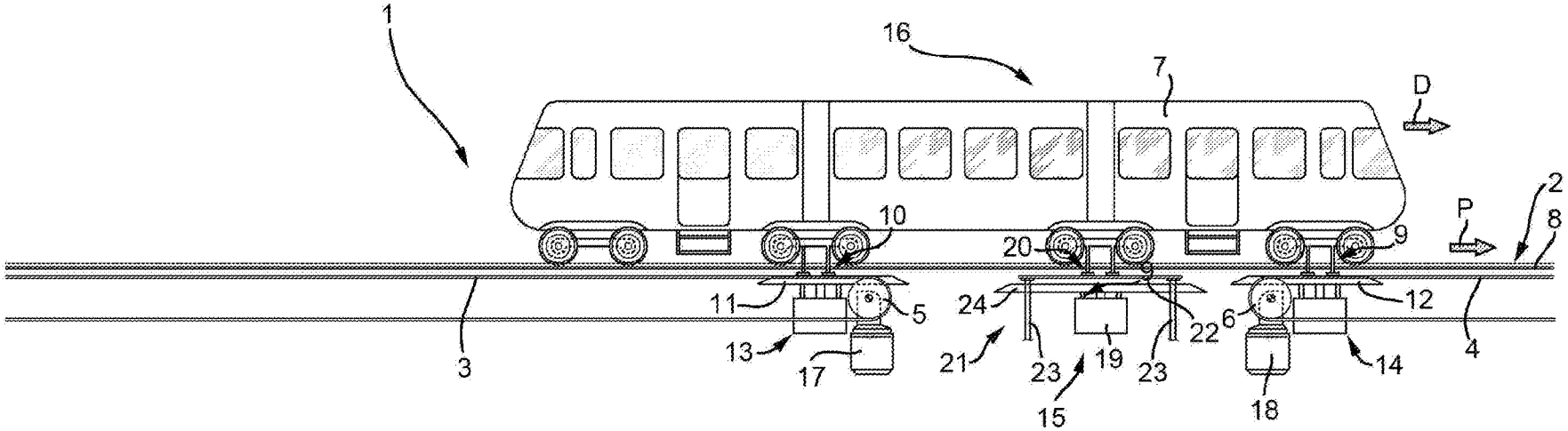

In particular, the first and the second control cams 11 and 12 are spaced apart from one another by a distance equal to the distance between the clamping devices 9 and 10 in such a way that when the clamping device 9 is at the control cam 12, the clamping device 10 is at the control cam 11 as shown in FIGS. 3 and 4.

The locking device 15 comprises a first locking member 20 bound to the vehicle 7 and a second locking member 21 fixed with respect to the track 2 and configured to cooperate with the locking member 20. In practice, the locking members 20 and 21 are selectively and mutually coupled to each another. In particular, the locking member 20 is arranged between the two clamping devices 9 and 10, while the locking member 21 is arranged between the two cams 11 and 12. The locking member 20 is spaced apart from the clamping device 9 by a distance equal to the distance between the control cam 12 and the locking member 21 in such a way that when the clamping devices 9 and 10 are arranged at the respective cams 12 and 11, the locking member 20 is arranged at the locking member 21.

In particular, the locking member 20 is defined by a clamping device of the same type as the clamping devices 9 and 10 and aligned with the clamping devices 9 and 10 and then in use is also clamped to the haul cables 3 and 4 when located at them, while the locking member 21 comprises a cable section 22, which is stretched out between two supports 23 and is aligned with the end sections of the haul cables 3 and 4. In accordance with an embodiment not shown, the cable section 22 is replaced with a bar of diameter equal to that of the cable section 22. The locking device 15 also comprises a control cam 24 whose position is controlled by the actuator 19 so as to arrange the control cam 24 either in an operating position in which the control cam 24 intercepts the clamping devices 9 and 10 and the locking member 20, or in a resting position.

Figure 8:
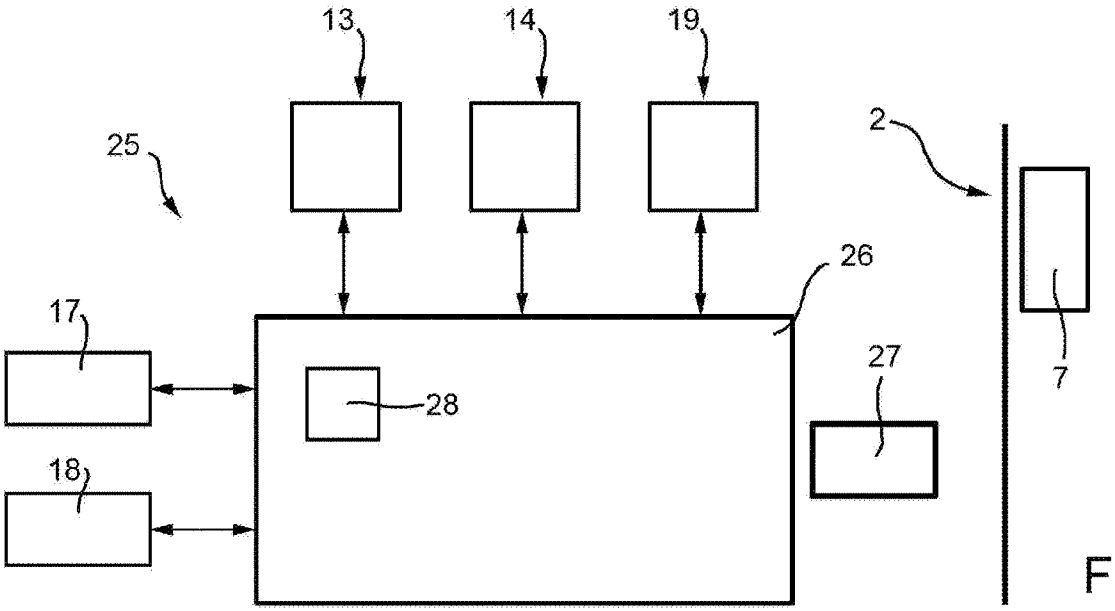
FIG. 8 is a schematic view, with parts removed for clarity, of a control device of the cable transportation system which is a feature of the present disclosure.

With reference to FIG. 8, the cable transportation system 1 comprises a control device 25 comprising a control unit 26 configured to acquire the position of the vehicle 7 along the track 2; and sensors 27 configured to detect the position of the vehicle 7.

In particular, the control unit 26 is configured to control the first motor 17 and the second motor 18 and the actuators 13, 14 and 19 as a function of a predetermined program which comprises a deceleration phase for the vehicle 7, a stop phase for the vehicle 7, and an acceleration phase for the vehicle 7.

The control unit 26 is configured to acquire the status of the condition of the motors 17 and 18 and the actuators 13, 14 and 19 and comprises a memory 28 for storing the signals acquired by the sensors 27, the motors 17 and 18 and the actuators 13, 14 and 19.

The control unit 26 is configured to arrange the cams 11 and 12 in the operating position when the locking device 15 locks the vehicle 7 at the passenger embarking and disembarking station 16 so as to enable the free and independent operation of each of the haul cables 3 and 4 in the stop phase of the vehicle 7.

Figure 2:
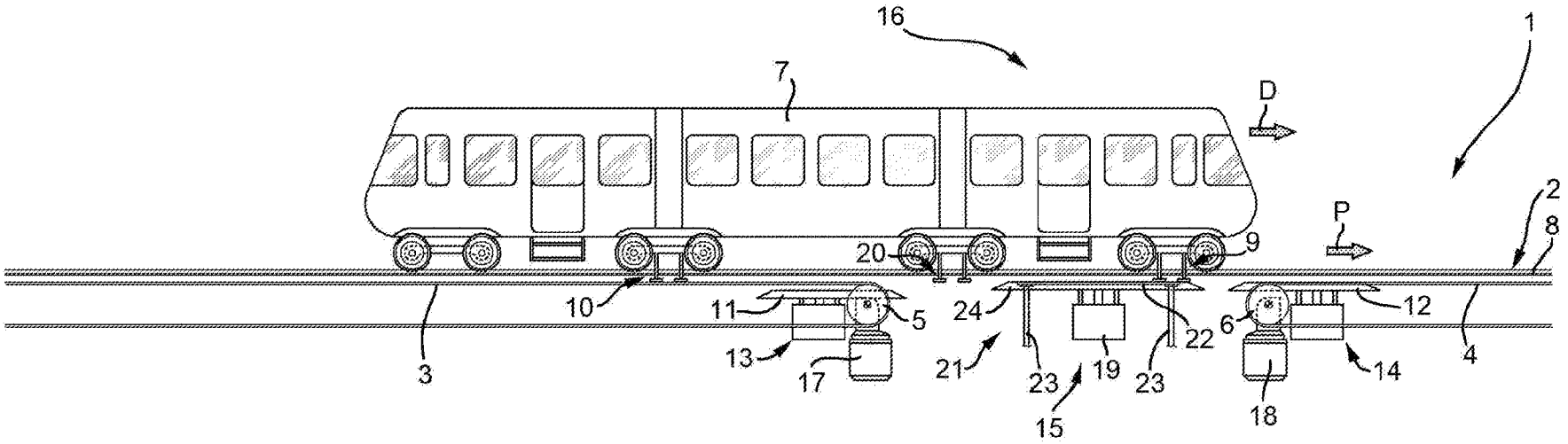

In use, with reference to FIG. 1, the clamping device 10 is clamped to the haul cable 3, the clamping device 9 is in the release phase from the haul cable 3, and the cams 11 and 12 and the locking member 20 are arranged in the operating position. In practice, the locking member 20 is aligned with the clamping devices 9 and 10 and grips the haul cable 3. The vehicle 7 decelerates until the vehicle stops as the vehicle nears the station 16. In the deceleration phase when the clamping device 9 and the locking member 20 have passed the control cam 11, the control cam 11 is arranged in the resting position (i.e., lowered) as shown in FIG. 2.

Subsequently, the deceleration of the vehicle 7 continues until the vehicle 7 is stopped precisely when the clamping devices 9 and 10 are respectively arranged at the respective cams 12 and 11 as shown in FIG. 3. When the vehicle 7 is in this position, the locking member 20 is arranged at the locking member 21 and the vehicle 7 is clamped only to the cable 3, is released from the cable 4 and the locking device 15 is not in operation.

Once the vehicle 7 has stopped, the locking device 15 is operated by moving the locking member 21 so that it does not interfere with the locking member 20, which promptly clamps the cable section 22. The control cam 11 is arranged in the operating position and as a result the vehicle 7 is released from the haul cable 3, which can be operated without interfering with the vehicle 7 as shown in FIG. 4.

Figure 5:
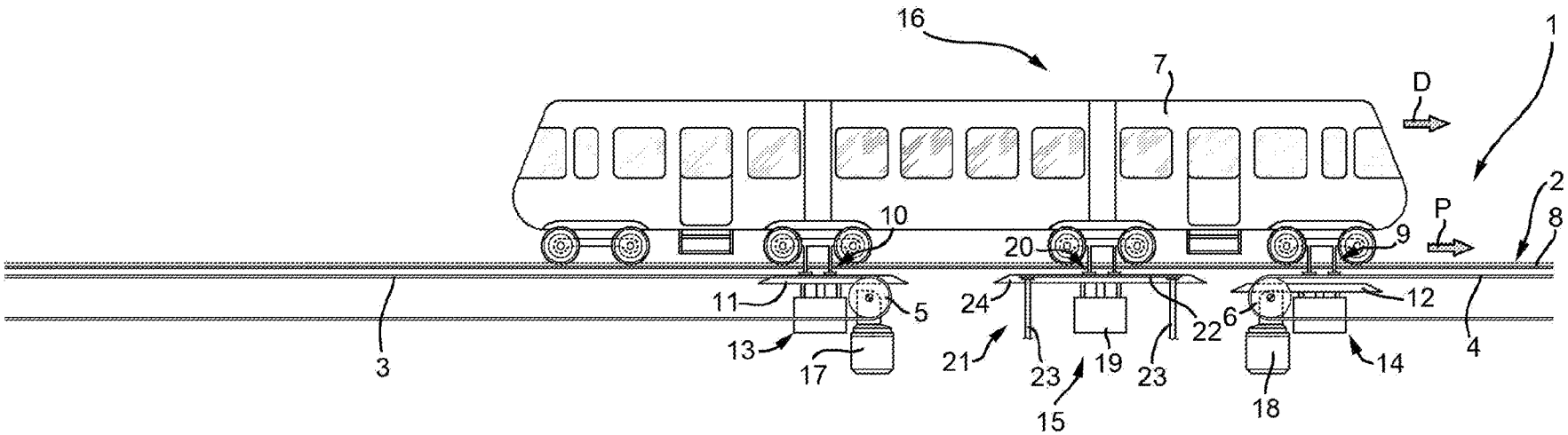

The haul cable 4 is stopped so that the haul cable is stationary when the vehicle 7 has finished its stop. Once the haul cable 4 has stopped, the control cam 12 is brought into the resting position so as to enable the clamping device 9 to clamp the haul cable 4. The locking device 15 is then disengaged so as to release the locking members 20 and 21 from each another as shown in FIG. 5.

Figure 6:
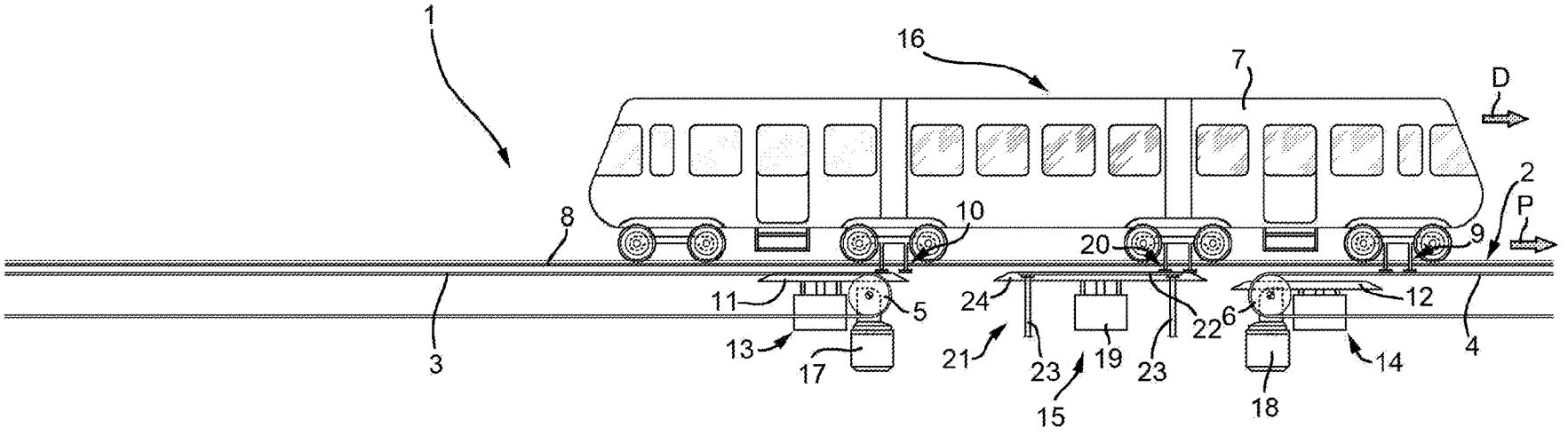

The haul cable 4 is then started and the vehicle 7 is advanced together with the haul cable 4 as shown in FIG. 6. In the configuration shown in FIG. 6, the control cam 12 is in the resting position (i.e., lowered), the control cam 11 is in the operating position (i.e., raised), and the control cam 24 of the locking device 15 is in the raised position.

Figure 7:
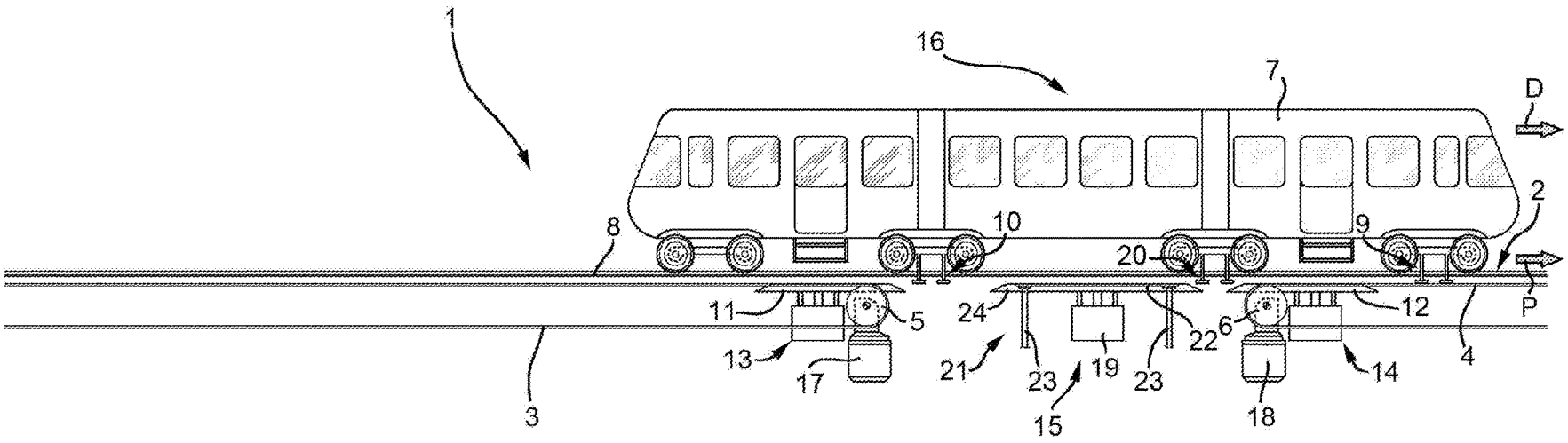

As soon as the clamping device 9 has passed the control cam 12, the control cam 12 is brought into the operating position (i.e., raised) to enable the clamping of the clamping device 10 and the locking member 20 to the cable 4 as shown in FIG. 7.

In the alternative embodiment shown in FIGS. 9 to 14, the locking device 15 is omitted and the vehicle 7 is held stationary when the vehicle is clamped to the haul cable 3 in the resting position or to the haul cable 4.

Figure 9:
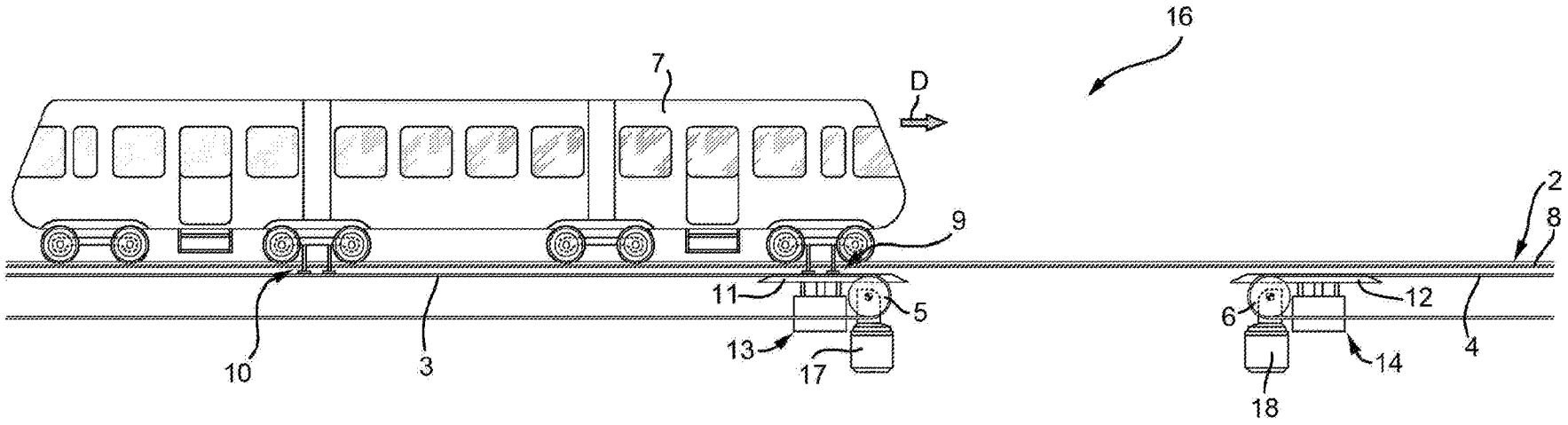
FIGS. 9 to 14 are schematic views in side elevation, with parts removed for clarity, of an alternative embodiment of the cable transportation system which is a feature of the present disclosure in a series of operating phases.
Figure 10:
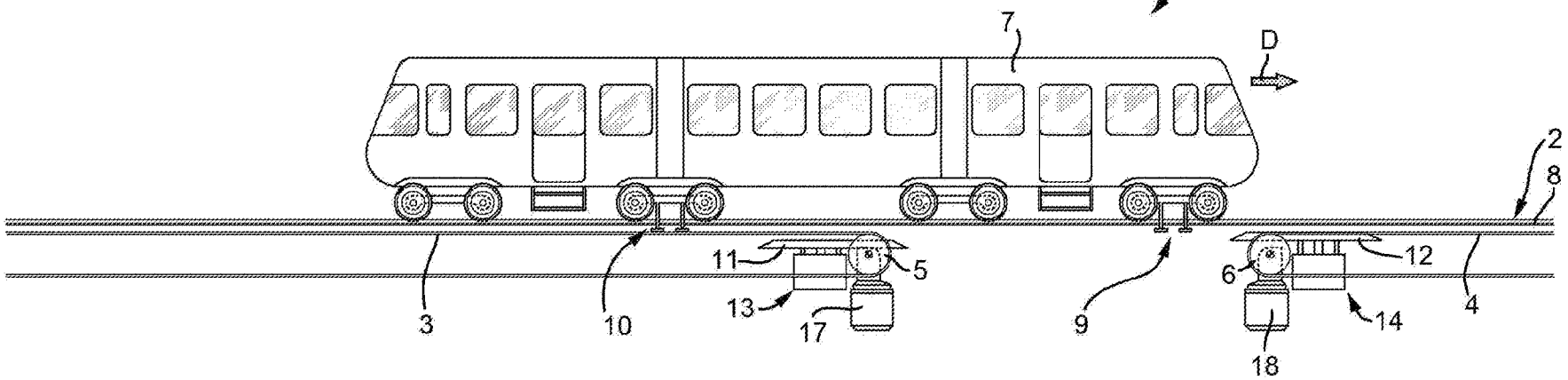

In use, with reference to FIG. 9, the clamping device 10 is clamped to the haul cable 3, the clamping device 9 is in the release phase from the haul cable 3, and both the cams 11 and 12 are arranged in the operating position. The vehicle 7 decelerates until the vehicle stops as the vehicle nears the station 16. In the deceleration phase when the clamping device 9 has passed the control cam 11, the control cam 11 is arranged in the resting position (i.e., lowered) as shown in FIG. 10.

Figure 11:
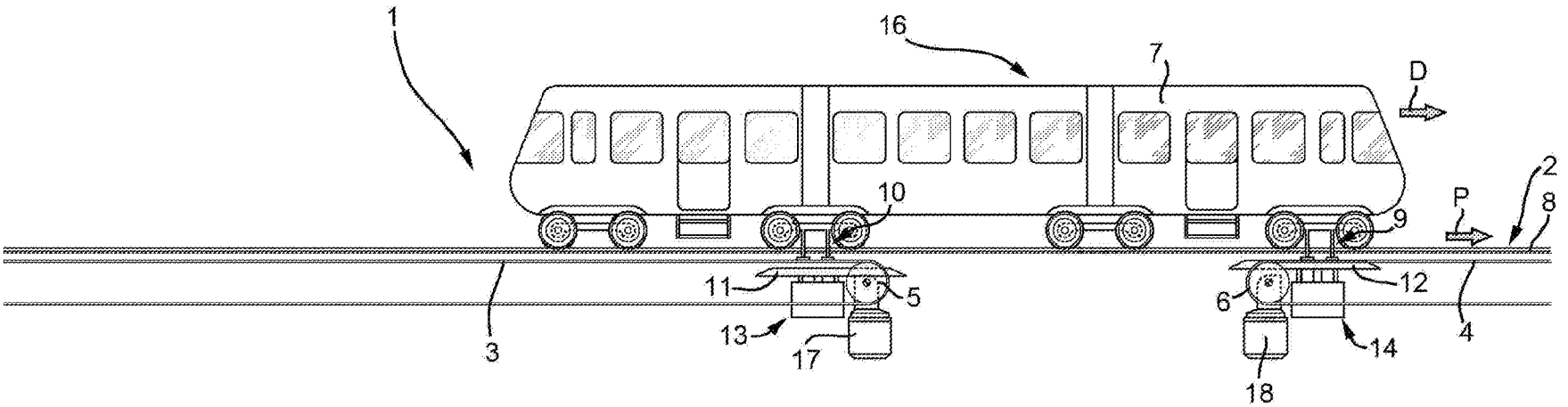

The deceleration of the vehicle 7 then continues until the vehicle 7 is stopped in a position wherein the clamping devices 9 and 10 are respectively arranged at the respective cams 12 and 11 as shown in FIG. 11.

Figure 12:
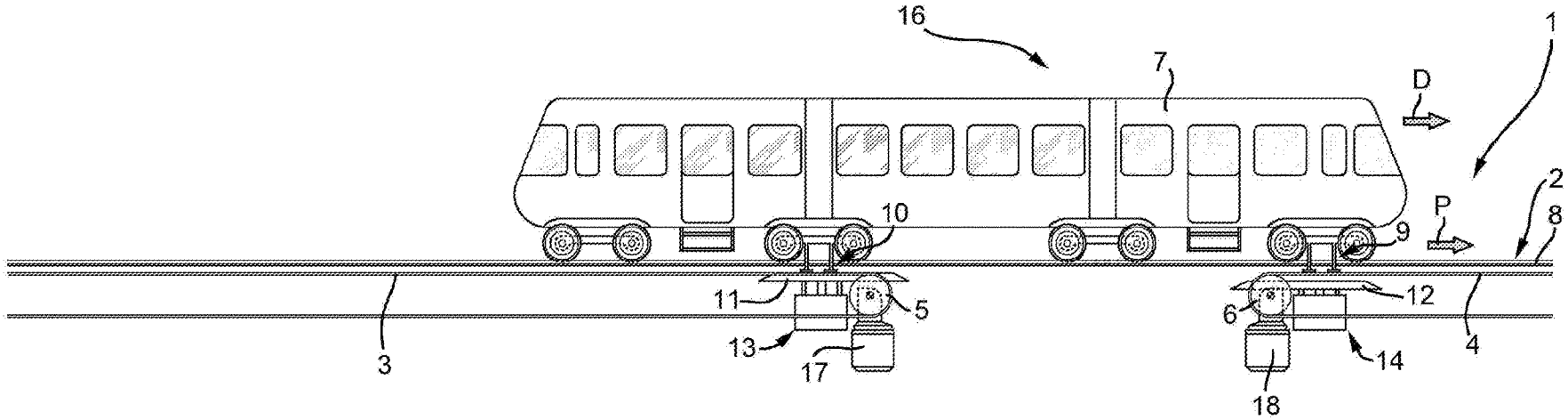

During the stop phase of the vehicle 7, the vehicle 7 remains clamped to the haul cable 3, which remains stationary for the entire stop phase, while the haul cable 4 is freely movable depending on the system's needs. The haul cable 4 is stopped so that the haul cable is stationary when the vehicle 7 has finished its stop. Once the haul cable 4 has stopped, the control cam 12 is arranged in the resting position so as to enable the clamping device 9 to clamp the cable 4 and simultaneously the control cam 11 is arranged in the operating position so as to release the vehicle 7 from the haul cable 3 as shown in FIG. 12. From this time, the haul cable 3 can be moved independently in the subsequent movement stages of the vehicle 7.

Figure 13:
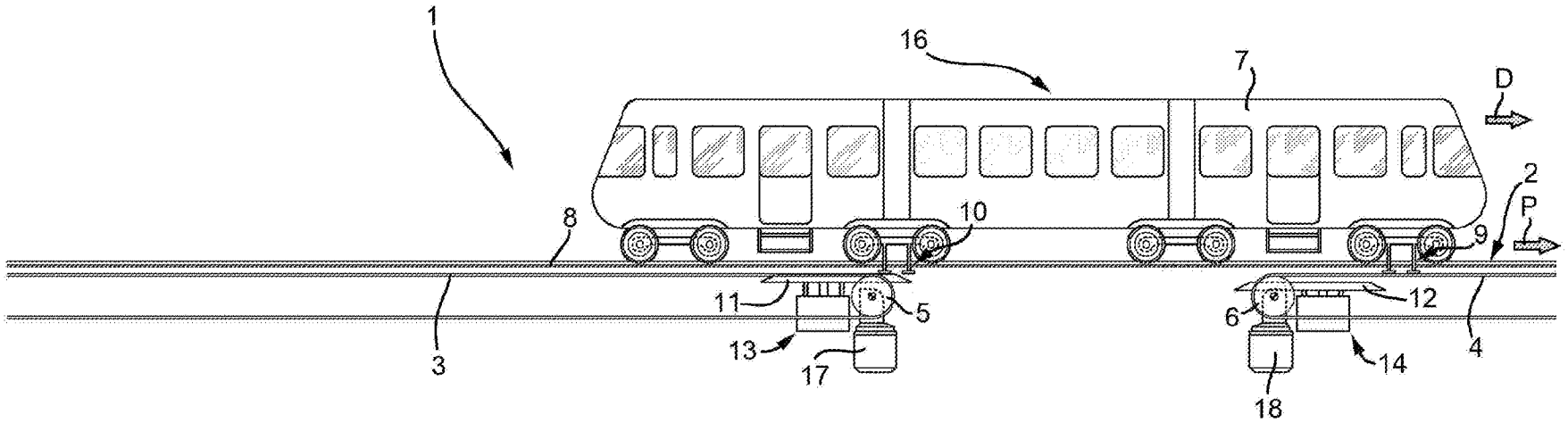

The haul cable 4 is then started and the vehicle 7 is advanced together with the haul cable 4 as shown in FIG. 13. In the configuration shown in FIG. 13, the control cam 12 is in the resting position (i.e., lowered), and the control cam 11 is in the operating position (i.e., raised).

Figure 14:
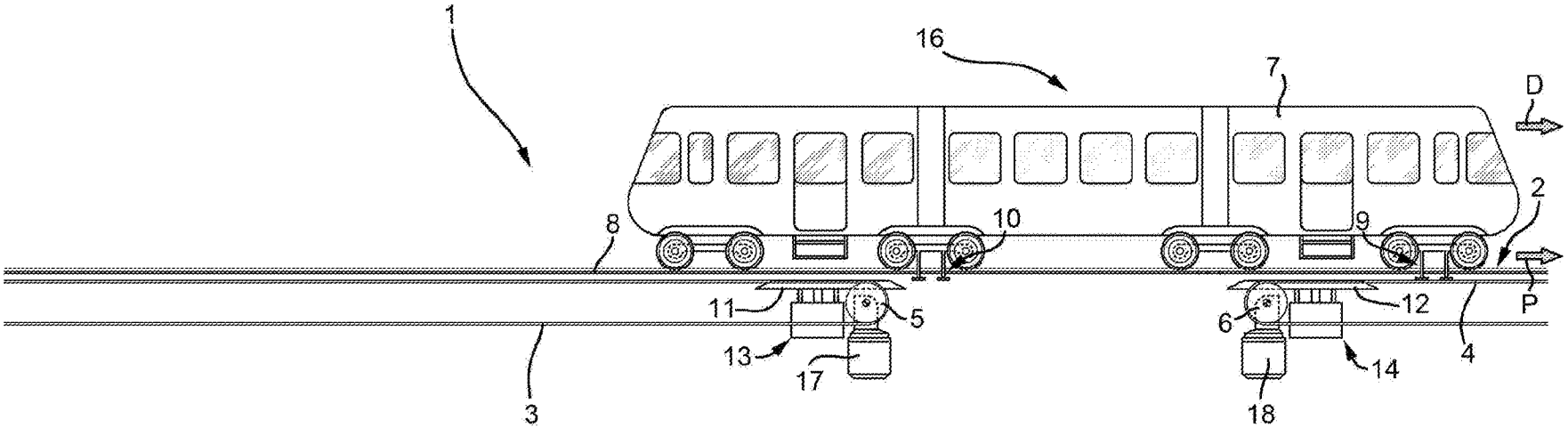

As soon as the clamping device 9 has passed the control cam 12, the control cam 12 is brought into the operating position (i.e., raised) to enable the clamping of the clamping device 10 to the cable 4 as shown in FIG. 14.

The embodiment described with reference to FIGS. 9 to 14 is relatively simpler to construct but allows only one of the two haul cables 3 and 4 to be freely used during stop phases. In addition, the control device 25 shown in FIG. 8 is relatively simplified because the actuator 19 is omitted.

In the present disclosure, the term "control cam" shall be taken to mean a complete control cam that comprises an opening ramp and a closing ramp for the clamping devices. When the control cam is arranged in the operating position and the vehicle advances, the clamping device which interferes with the cam performs a cycle of opening and closing.

Finally, it is clear that the cable transportation system described and claimed may be subject to modifications and variations without thereby departing from the scope of protection defined by the appended claims. As such, the present disclosure also covers embodiments not described in the detailed description and equivalent embodiments that fall within scope of the appended claims. Accordingly, various changes and modifications to the presently disclosed embodiments will be apparent to those skilled in the art. Such changes and modifications can be made without departing from the spirit and scope of the present subject matter and without diminishing its intended technical scope. It is therefore intended that such changes and modifications be covered by the appended claims.

The invention claimed is:

1. A cable transportation system extending along a track, the cable transportation system comprising:

a first haul cable extending at least partially along the track and having an end section, the first haul cable being actuated via a first motor;

a second haul cable extending at least partially along the track and having an end section aligned with the end section of the first haul cable, the second haul cable being actuated via a second motor a vehicle comprising:

a first clamping device configured to selectively attach the vehicle to the first haul cable, and a second clamping device configured to selectively attach the vehicle to the second haul cable;

a passenger embarking and disembarking station at the end sections of the first haul cable and the second haul cable;

a first control cam arranged at the end section of the first haul cable, the first control cam comprising an opening ramp and a closing ramp for the first and second clamping device;

a second control cam arranged at the end section of the second haul cable, the second control cam comprising an opening ramp and a closing ramp for the first and second clamping device, wherein a distance that the first control cam and the second control cam are spaced apart and a distance that the first clamping device and the second clamping device are spaced apart provides that when the first clamping device is arranged at the second control cam, the second clamping device is arranged at the first control cam;

a first actuator configured to selectively move the first control cam between an operating position for opening and closing the first clamping device and a resting position in which the first control cam does not interfere with the first clamping device, wherein when the first control cam is arranged in the operating position and the vehicle advances, the first clamping device performs a cycle of opening and closing; and a second actuator configured to selectively move the second control cam between an operating position for opening and closing the second clamping device and a resting position in which the second control cam does not interfere with the second clamping device, wherein when the second control cam is arranged in the operating position and the vehicle advances, the second clamping device performs a cycle of opening and closing.

2. The cable transportation system of claim 1, further comprising a locking device configured to hold the vehicle stationary when the vehicle is released from the first haul cable and the second haul cable.

3. The cable transportation system of claim 2, wherein the locking device comprises a first locking member bound to the vehicle and a second locking member bound to the track, the first locking member and the second locking member being coupleable to one another.

4. The cable transportation system of claim 3, wherein the first locking member comprises a locking member clamping device and the second locking member comprises one of: a cable section and a bar with a diameter corresponding to the cable section.

5. The cable transportation system of claim 4, wherein the locking member clamping device is aligned with the first clamping device and the second clamping device.

6. The cable transportation system of claim 3, wherein the locking device comprises a third control cam moveable between:

an operating position wherein the third control cam interferes with the first locking member to open and close the locking device and keep the locking device released from or attached to the second locking member, and a resting position wherein the second locking member does not interfere with the first locking member.

7. The cable transportation system of claim 1, further comprising a control device including:

a control unit configured to acquire a position of the vehicle along the track and control at least one of the first motor, the second motor, the first actuator, and the second actuator based on the position of the vehicle; and a plurality of sensors configured to retrieve the position of the vehicle along the track.

8. The cable transportation system of claim 7, wherein the control unit is configured to control at least one of the first motor, the second motor, the first actuator and second actuator based on a predetermined cycle including a deceleration phase of the vehicle, a vehicle stop phase, and an acceleration phase of the vehicle.

9. The cable transportation system of claim 8, wherein the control unit is configured to bring the first control cam and the second control cam into the operating or resting position when the vehicle is stationary in the passenger embarking and disembarking station.

10. A cable transportation system extending along a track, the cable transportation system comprising:

a first haul cable extending at least partially along the track and having an end section, the first haul cable being actuated via a first motor;

a second haul cable extending at least partially along the track and having an end section aligned with the end section of the first haul cable, the second haul cable being actuated via a second motor a passenger embarking and disembarking station at the end sections of the first haul cable and the second haul cable;

a first control cam arranged at the end section of the first haul cable, the first control cam comprising an opening ramp and a closing ramp for a first clamping device of a vehicle and a second clamping device of the vehicle, wherein the first clamping device of the vehicle configured to selectively attach the vehicle to the first haul cable, and the second clamping device of the vehicle is configured to selectively attach the vehicle to the second haul cable;

a second control cam arranged at the end section of the second haul cable, the second control cam comprising an opening ramp and a closing ramp for the first clamping device of the vehicle and the second clamping device of the vehicle, wherein when the first clamping device of the vehicle is arranged at the second control cam, the second clamping device of the vehicle is arranged at the first control cam;

a first actuator configured to selectively move the first control cam between an operating position for opening and closing the first clamping device of the vehicle and a resting position in which the first control cam does not interfere with the first clamping device of the vehicle, wherein when the first control cam is arranged in the operating position and the vehicle advances, the first clamping device of the vehicle performs a cycle of opening and closing; and a second actuator configured to selectively move the second control cam between an operating position for opening and closing the second clamping device of the vehicle and a resting position in which the second control cam does not interfere with the second clamping device of the vehicle, wherein when the second control cam is arranged in the operating position and the vehicle advances, the second clamping device of the vehicle performs a cycle of opening and closing.

11. The cable transportation system of claim 10, further comprising a locking device configured to hold the vehicle stationary when the vehicle is released from the first haul cable and the second haul cable.

12. The cable transportation system of claim 11, wherein the locking device comprises a first locking member bound to the vehicle and a second locking member bound to the track, the first locking member and the second locking member being coupleable to one another.

13. The cable transportation system of claim 12, wherein a clamping device of the first locking member is aligned with the first clamping device of the vehicle and the second clamping device of the vehicle.

14. The cable transportation system of claim 11, wherein the locking device comprises a third control cam moveable between:

an operating position wherein the third control cam interferes with the first locking member to open and close the locking device and keep the locking device released from or attached to the second locking member, and a resting position wherein the second locking member does not interfere with the first locking member.

15. The cable transportation system of claim 10, further comprising a control device including:

a control unit configured to acquire a position of the vehicle along the track and control at least one of the first motor, the second motor, the first actuator, and the second actuator based on the position of the vehicle; and a plurality of sensors configured to retrieve the position of the vehicle along the track.

16. The cable transportation system of claim 15, wherein the control unit is configured to control at least one of the first motor, the second motor, the first actuator and second actuator based on a predetermined cycle including a deceleration phase of the vehicle, a vehicle stop phase, and an acceleration phase of the vehicle.

17. A method for operating a cable transportation system, the method comprising:

advancing a vehicle comprising a first clamping device and a second clamping device along a track via one of: a first haul cable that extends at least partially along the track and has an end section, and a second haul cable that extends at least partly along the track and has an end section, wherein the end section of the first haul cable and the end section of the second haul cable are aligned;

controlling an opening and a closing of the first clamping device and second clamping device at the end sections of the first haul cable and the second haul cable via a first control cam and a second control cam that are each moveable between an operating position wherein they interfere with the first clamping device and the second clamping device for opening and closing, in sequence, the first clamping device and the second clamping device and a resting position wherein they do not interfere with the first clamping device and the second clamping device, wherein each control cam comprises an opening ramp and a closing ramp for the first clamping device and the second clamping device such that when each control cam is arranged in the operating position and the vehicle advances, the clamping device that interferes with that control cam performs a cycle of opening and closing;

holding the vehicle stationary via at least one of: a locking device, clamping the vehicle to the first haul cable, and clamping the vehicle to the second haul cable; and releasing the vehicle from at least one of: the first haul cable, the second haul cable, and the first haul cable and the second haul cable.

18. The method of claim 17, further comprising acquiring the position of the vehicle along the track and actuating at least one of the first control cam, the second control cam and the locking device based on the position of the vehicle along the track.

19. The method of claim 18, further comprising:

decelerating the first haul cable until the vehicle is stopped in a designated position;

holding the vehicle in said designated position; and releasing the vehicle from the first haul cable.

20. The method of claim 19, further comprising:

clamping the vehicle to the second haul cable when the vehicle is in the designated position;

unlocking the locking device; and accelerating the second haul cable together with the vehicle.

* * * * *